US006766988B1

(12) United States Patent
Richley

(10) Patent No.: US 6,766,988 B1
(45) Date of Patent: Jul. 27, 2004

(54) BLOCK OCCUPANCY DETECTOR FOR MODEL RAILROADS

(76) Inventor: Edward A. Richley, P.O. Box 64, Gaithersburg, MD (US) 20884

( * ) Notice: Subject to any disclaimer, the term of this patent is extended or adjusted under 35 U.S.C. 154(b) by 0 days.

(21) Appl. No.: 10/367,270

(22) Filed: Feb. 15, 2003

(51) Int. Cl.[7] ..... B61L 21/00
(52) U.S. Cl. ..... 246/20
(58) Field of Search ..... 246/20, 21, 22, 246/28 R, 122 R, 122 A

(56) References Cited

U.S. PATENT DOCUMENTS 5,417,388 A * 5/1995 Stillwell ..... 246/122 R
5,752,677 A * 5/1998 Richley ..... 246/122 A
6,367,742 B1 * 4/2002 Ireland ..... 246/1 C

OTHER PUBLICATIONS

P. Mallery, "Electrical Handbook for Model Railroads", (1955), pp. 174–190.
L. H. Westcott, Model Railroader, Jun. 1958, pp. 36–41.
C. Small, A. Madle, Model Railroader, Jul. 1947, pp. 536–539.
Hibbs, May, Model Railroader, Sep. 1947, pp742–744.
van Allen, Electronics, Dec. 1949, pp. 148–156.
L. H. Westcott, Model Railroader, Mar. 1950, pp. 62–64.

* cited by examiner

*Primary Examiner*—S. Joseph Morano
*Assistant Examiner*—Robert J. McCarry, Jr.

(57) ABSTRACT

A system and method for detecting the presence or absence of cars, locomotives, or obstructions which may occupy a particular section of track of a model railroad. Digital Command Control signals are used to provide the excitation voltage needed to perform a measurement of the capacitance of an unoccupied section of track. Deviations from this unoccupied capacitance are then measured to indicate occupancy.

11 Claims, 3 Drawing Sheets

BLOCK OCCUPANCY DETECTOR FOR MODEL RAILROADS

FIELD OF THE INVENTION

This invention relates to a block occupancy detector for model railroads in which track and equipment are miniature scale models of full sized equipment.

DESCRIPTION OF RELATED ART

Model railroads have long been built with the inclusion of signal systems designed to imitate the signaling practices of their prototypes. One component of such a signal system is the block occupancy detector. The block occupancy detector is responsible for detecting the presence of any object which spans the rails within a particular section of track (a block). Many types of block occupancy detectors have been utilized over the years. Mechanical switches, electrical relays, transistors, and integrated circuits have all been used in one form or another.

Many early systems used a relay coil placed in series between the track section and the propulsion power supply which powered the locomotives (see "Electrical Handbook for Model Railroads" by Paul Mallery, Simmons-Boardman, 1955). Schemes based on this method utilized the fact that the current drawn by a locomotive is substantial enough to trip the series-connected relay. Variations on this method have been created which allow less substantial loads to be detected. For example, the light bulb within a model passenger car could draw enough current to trip a more sensitive relay. These variations utilize an additional higher voltage power supply and are encumbered by the need to prevent false detection by currents which could flow back through the propulsion power supply. These relay based systems are based on direct current (DC) and only operate when a device which will conduct direct current (a DC load) is presented to the track.

When solid state devices became available, they began to replace relay circuits. Westcott's "Twin-T" circuit (Model Railroader, June 1958, p. 36) is an example of such a system. Again, only a locomotive or car presenting a DC load will be detected. Variations on this method have been made with more sensitive and less expensive components as transistors became less expensive and integrated circuits became available, but the DC load limitation persisted.

With these limitations, it has been inconvenient to imitate the practice of full scale railroads in which any rolling stock can be detected by the block occupancy detector. In the practice of full sized railroads, the rails are normally insulated from each other. Any car, locomotive, hand car, or other metal obstruction which spans the rails is detectable because it forms a connection between the rails. In general, this connection is considered to be a direct connection with very low resistance. Model railroads tend to provide electrical power for locomotives and car borne accessories from the two rails. A direct connection of low resistance across these rails is thus very undesirable. For this reason, wheels on opposite sides of model cars which do not require electrical power are carefully insulated from each other. Thus, detection of the presence of the vast majority of model cars has been difficult and largely neglected.

One method for circumventing this limitation on model railroads has been to provide a highly resistive conduction path across the rails on all cars. This is accomplished either by the use of resistors connected to the wheels, or through the use of conductive paint applied so as to span the insulation between opposing wheels. This practice is generally unsightly, unreliable, and inconvenient.

Some low frequency (60 Hz) occupancy detection circuits based on alternating current have been described. The method of Small (Model Railroader, July 1947) requires that cars be equipped with resistors.

The method of Madle (Model Railroader, July 1947) utilizes high frequency alternating current but with the requirement that cars be outfitted with capacitors to bridge the rails. The sensitivity of this scheme must be limited so that the stray capacitance of the track, itself, does not cause an indication of occupancy, whereas the additional capacitance of a properly outfitted car will cause such an indication.

In 1947 Hibbs and May are mentioned as having developed a method utilizing high frequency alternating current for occupancy detection (Model Railroader, September 1947, p. 742). The circuit was said to detect a change in capacitance between the rails such as that caused by the presence of metal wheels insulated from their axles. Insufficient details are given to determine the method of operation of the circuit or its effectiveness.

Van Allen describes a scheme based on high frequency alternating current (Electronics, December 1949, p. 148, also described in Model Railroader, March 1950, p63) which overcomes some of the limitations of the scheme of Madle. In Van Allen's method, the rails become part of a resonator which is weakly coupled to a high frequency oscillator by a resonant transformer with tunable secondary. The strength of the resonance is detected with a diode. In operation, the transformer is tuned for peak detected output with the track unoccupied. The presence of a suitably equipped car will take the resonator out of resonance and the detected output will subsequently drop. Van Allen claimed that cars which are equipped with capacitance as low as 10 picofarads can be detected with this circuit.

Richley (U.S. Pat. No. 5,752,677) describes a system for detecting minute capacitance changes by injecting a pulsating radio frequency signal onto the rails and, by the use of a balanced transformer, creating a null condition. Slight deviations from this null condition are detected as indications of occupancy. The null condition is obtained by adjustment of both capacitance and resistance in a nulling network.

Digital command control (DCC) has become an increasingly popular way to control various appliances, including locomotives, on model railroads. Among its other features, DCC allows individual locomotives to be independently controlled by encoding digital data into polarity reversals of the track voltage. Standards for DCC have been established by the National Model Railroad Association, as described in S-9.1 of that organization, and can be found at http://www.nmra.org. With this level of technological sophistication becoming commonplace in the pursuit of realistic operation, it is also desirable to provide realistic occupancy detection of unmodified rolling stock.

SUMMARY OF THE INVENTION

The object of the present invention is to provide a means for detection of unmodified rolling stock on a model railroad which is equipped with digital command control (DCC). The present invention accomplishes detection of unmodified rolling stock by measuring the slight change in capacitance of a section of track which occurs when an occupying car is present. The invention enables the capacitance of the track circuit to be measured independently of any track resistance effects. The invention is particularly well suited to systems DCC of the type wherein track voltage alternates abruptly and frequently between positive and negative extremes.

In order to accurately imitate the practice of full scale railroads while providing propulsion power through two rails, some means of detecting cars which do not present a DC load is needed. The present invention accomplishes this in the presence of DCC by the use of a current transformer, current amplifier, and correlator to form what is essentially an electrometer for the measurement of charge transferred to the empty track section with each polarity reversal of the track voltage. This charge measurement represents the capacitance of the track section, and deviations from the measurement in an unoccupied condition represent occupancy detection events.

The slight amount of current which charges the capacitance of a track section with each alternating transition of track voltage is amplified and filtered so as to create alternating pulses with amplitude proportional to the charge transferred to the track section. These alternating pulses are then passed through a correlator in which they are correlated with the alternating track voltage so as to suppress extraneous noise and to leave that component of signal which is proportional to track capacitance.

In order to greatly increase the sensitivity of the detection, some form of synchronous cancellation is provided. In the present invention, this cancellation need only to provide pulses of adjustable magnitude which can be subtracted from the track current pulses so as to allow substantial gain to follow this cancellation stage without risk of saturation of subsequent stages. The alternating cancellation pulses are then adjusted in magnitude until the output of the correlator is within the linear range of a measuring analog-to-digital converter when the track section is unoccupied. From this null condition, variations in correlator output are interpreted as occupancy events.

Such detection circuits should, for best results, be located near the track feed points, so as to minimize any overhead capacitance due to wiring. Correlator outputs from several such track sections are then connected to a common signal controller, which contains a controlling microprocessor and a multiplexed analog-to-digital converter, so that several blocks could be controlled and monitored with a common controller.

In contrast with prior art capacitive sensing systems, the present invention allows for a common rail connection, and does not require that both rails be gapped for each block. Furthermore, cancellation pulses need not be replicas of track current pulses in order to be effective. They only need to exhibit consistency in their time-integral, as presented to the correlator, for any given adjustment level. Then, only the magnitude of these pulses must be adjusted for nulling, since the time integration step inherent in the correlation process will remove any ramification of the particular shape of either the track current pulses or the cancellation pulses. There is no need for further adjustment of phase, in addition to amplitude, as with previous detection systems such as in the '677 patent.

Variations in sensed track current pulses resulting from variations in transition time of track voltage are substantially mitigated by the integration step inherent in the correlation process. In contrast, variations in amplitude of the alternating DCC track power signal, as may occur from loading of a common booster circuit due to locomotives in other blocks, will cause variations in correlator output. However, the amplitude of this booster output is also available either at each block detection circuit, or at a common signal controller. Thus, a measurement of the concurrent track voltage magnitude can easily be made and delivered to the microprocessor by the use of an analog-to-digital converter. Compensation for changes in the correlator output due to variations in track voltage can then be made in software.

DETAILED DESCRIPTION OF THE INVENTION

Figure 1:
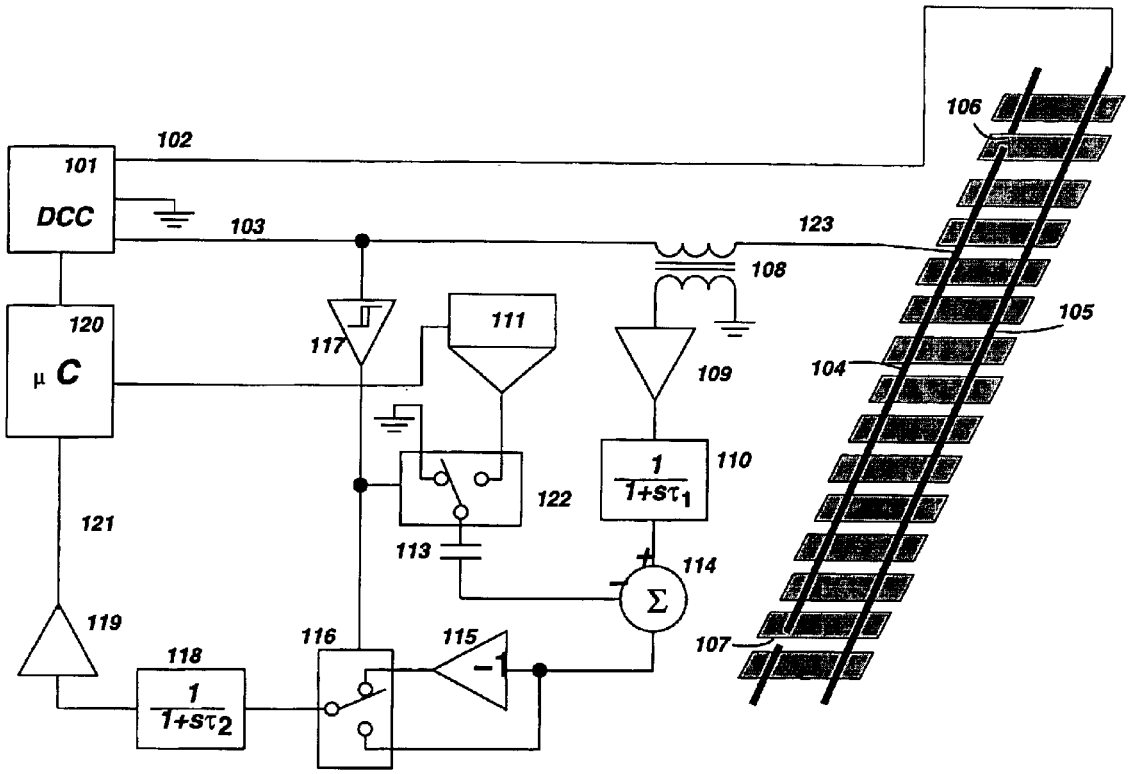
FIG. 1 shows a block diagram of a basic system according to the invention, showing DCC booster 101, controlling microprocessor 120, common rail track feeder 102, gapped rail booster output 103, gapped rail track feeder 123, current sensing transformer 108, sense amplifier 109, pulse filter network 110, nulling DAC 111, nulling switch 122, nulling capacitor 113, summer 114, inverting amplifier 115, switch 116, level translator 117, low-pass filter 118, and amplifier 119.

FIG. 1 shows a block diagram of an exemplary embodiment of the invention. DCC booster 101 provides a periodic complementary power pulses onto common rail track feeder 102 and gapped rail booster output 103. These signals are typically derived from an "H-bridge" circuit, and swing from a voltage near ground, to some positive voltage of 12–15 V in a time of a few microseconds or less. The duration of any pulse is at least 58 microseconds. Since the voltage on 102 and 103 are complementary, there is a positive voltage present on one or the other at any given instant. Enough current is available from booster 101 to power locomotives. The timing of the polarity reversals between 102 and 103 provide control information to devices, such as controllers within locomotives, in order to control speed, lights, etc., by methods well-known in the model railroad industry. Booster output is connected to track feeder 123 through current transformer 108. Since current transformer 108 consists of only a few turns on a ferrite core, its impedance is low, and feeder 123 carries the same current as output 103, with nearly the same voltage. Common rail 105 receives current from booster 101 via feeder 102. Rail gaps 106 and 107 serve to isolate gapped rail 104 so as to form a track section. In practice, the track section represents one block of a model railroad, wherein it is desired to detect occupancy.

A typical block in HO scale (3.5 mm corresponding to 1 foot) is several feet in length. The mutual capacitance between rails 104 and 105 of such a block is some tens of picofarads (typically 30 pF), depending upon the actual length and configuration of the block. In its unoccupied state, the mutual capacitance of these rails, along with that between feeder 123 and feeder 102 will cause there to be some measurable amount of charge transferred during each polarity reversal of booster 101, according to the relation:

$$\Delta Q = C\Delta V$$

where $\Delta Q$ is the change in charge on the net capacitance of feed wires (123, 102) and rails (104, 105), C is the total mutual capacitance of that structure (rails and wires) and $\Delta V$ is the change in track voltage during the polarity reversal. For example, with a 15V swing on each output of booster 101, ΔV will be equal to 30V, since the relative voltage of the feeders and rails will switch from positive 15V to negative 15V. With a track capacitance of 30 pF and feeder capacitance of 20 pF, for example, a total capacitance of 50 pF experiences a voltage change of 30V, for a net charge transfer of 1.5 nC. This is a small amount of charge, but it is not immeasurable.

Transformer 108 is arranged so that for times shorter than some tens of microseconds, but well inclusive of the transition time for polarity reversals of booster 101, the current in the secondary is a substantial replica of that in the primary. Amplifier 109 converts the current impulses at its input, as caused by relatively fast voltage transitions in the track circuit, to voltage impulses at its output. These impulses are of alternating polarity corresponding to the polarity reversals of the track circuit.

Pulse filter network 110 transforms these short impulses into lower amplitude pulses which decay with some characteristic time, $\tau_1$, chosen to be substantially longer than the rise time of the track voltage, and should be at least 10 microseconds. The output of pulse filter network 110 is an alternating sequence of temporally stretched pulses, each of which is decaying toward a quiescent value with some decay rate determined by $\tau_1$ and also by the time constant formed by the secondary inductance of transformer 108 divided by the input resistance of amplifier 109. Each of these alternating pulses is synchronous with the alternating track voltage. This operation of pulse filtering allows the subsequent correlation process to be particularly simple.

Meanwhile, another set of alternating decaying pulses is being generated by digital-to-analog converter (DAC) 111, nulling switch 122, and coupling capacitor 113. These components comprise a nulling circuit. Pulses produced by the nulling circuit are also synchronous with the track voltage, as sensed by level translator 117. This set of pulses is then subtracted from the pulses derived from track current by summer 114. At any given time, DAC 111 presents some analog voltage at its output, and alternating pulses with magnitude determined by that value are applied to summer 114, through capacitor 113, in synchrony with the track voltage by the action of nulling switch 122. By connecting nulling switch 122 so as to present these pulses with opposite phase to the track current pulses, summer 114 will subtract the cancellation pulses from the track current pulses.

The output of summer 114 then consists of the difference of these alternating pulses. Adjustment of the state of DAC 111 will result in more or less contribution from the nulling circuitry.

Inverting amplifier 115, switch 116, and low-pass filter 118 form a correlator which serves to correlate the alternating pulse combination with the track voltage. Switch 116 is controlled by the polarity of track voltage, as sensed by level translator 117, and switches in synchrony with it. One input of switch 116 carries the amplified pulse combination, while the other input carries its inverse. Alternate polarities of track voltage cause alternate inputs of switch 116 to be passed through to its output, so that the resulting output of switch 116 contains a sequence of amplified pulse combinations, all of the same orientation. The output of switch 116 is then filtered with low-pass filter 118, having time constant $\tau_2$, which is chosen to be much longer than a complete cycle of the track voltage, and is likely greater than 10 ms. In this manner, the output 121 of amplifier 119 is relatively slowly varying, and forms the correlation of the pulse combination with track voltage.

It can now be seen that pulse filter network 110 serves not only to limit the amplitude and reduce the necessary response time of amplification stages, but also to delay the measured track current impulse, so that track polarity can be used to control the polarity of switch 116 and, hence, the correlation process. In the absence of pulse filter network 110, track current impulses would be coincident with transitions of switch 116, and no proper correlation would be performed. Alternate embodiments can be devised in order to eliminate pulse filter network 110, if advanced knowledge of each track voltage transition is available, as might be possible with access to internal signals within booster 101.

With the track section unoccupied, a measurement is performed to determine the magnitude of signal 121 corresponding to the unoccupied condition. Changes from this condition are then interpreted by microcontroller 120 as occupancy events. It is desirable to detect changes as little as 1 pF, as is typical of a plastic boxcar with a metal body weight, metal wheels and plastic axles. This corresponds to only a few percent, and perhaps even leas than one percent in some cases, of the total track and feeder capacitance.

Amplifier 119 must have considerable gain so that such small changes are measureable by the analog-to-digital converter contained in microcontroller 120. In order to provide such gain, while ensuring that signal 121 is within range of the converter input, DAC 111 is made to adjust its output so as to bring the output 121 to some value within this range in the unoccupied condition. If output 121 is too high in voltage, the value to which nulling DAC 111 is set is increased, so as to introduce more out-of-phase signal at the negative input so summer 114, thus reducing the correlator output and, hence, the level at output, 121. Likewise, if output 121 is below the desired input range, DAC 111 is made to reduce its output, reducing the out-of-phase component of the alternating pulses at the output of summer 114, and creating a correlator output which is more positive and, thus, increasing output 121. In this manner, the dynamic range of the system is greatly increased over what it would be in the absence of a nulling procedure.

This nulling adjustment procedure is to be performed once in the unoccupied condition, under the control of microcontroller 120.

It is important to understand that, since DCC signals are substantially square, the vast majority of charge is transferred onto the various capacitances within a short time after the voltage transition, itself. The correlation time, $\tau_2$, as determined by low-pass filter 118 is much longer than this transition time or the pulse decay rates. As a consequence of this integration process, it is not necessary that instantaneous voltages at the inputs to summer 114 substantially cancel, but only that their integration over some reasonable time, say 20 microseconds, substantially cancel. Thus, unlike Richley U.S. Pat. No. 5,752,677, there is no need for resistive and capacitive adjustment for the balancing of amplitude and phase. Only amplitude adjustment is needed.

Power to drive this circuit can be derived directly from track voltage. Also, signals sent to nulling DAC 111 can be sent as DCC commands directly over the track circuit, by the use of a suitable DCC decoder, in order to activate the nulling operation.

Figure 2:
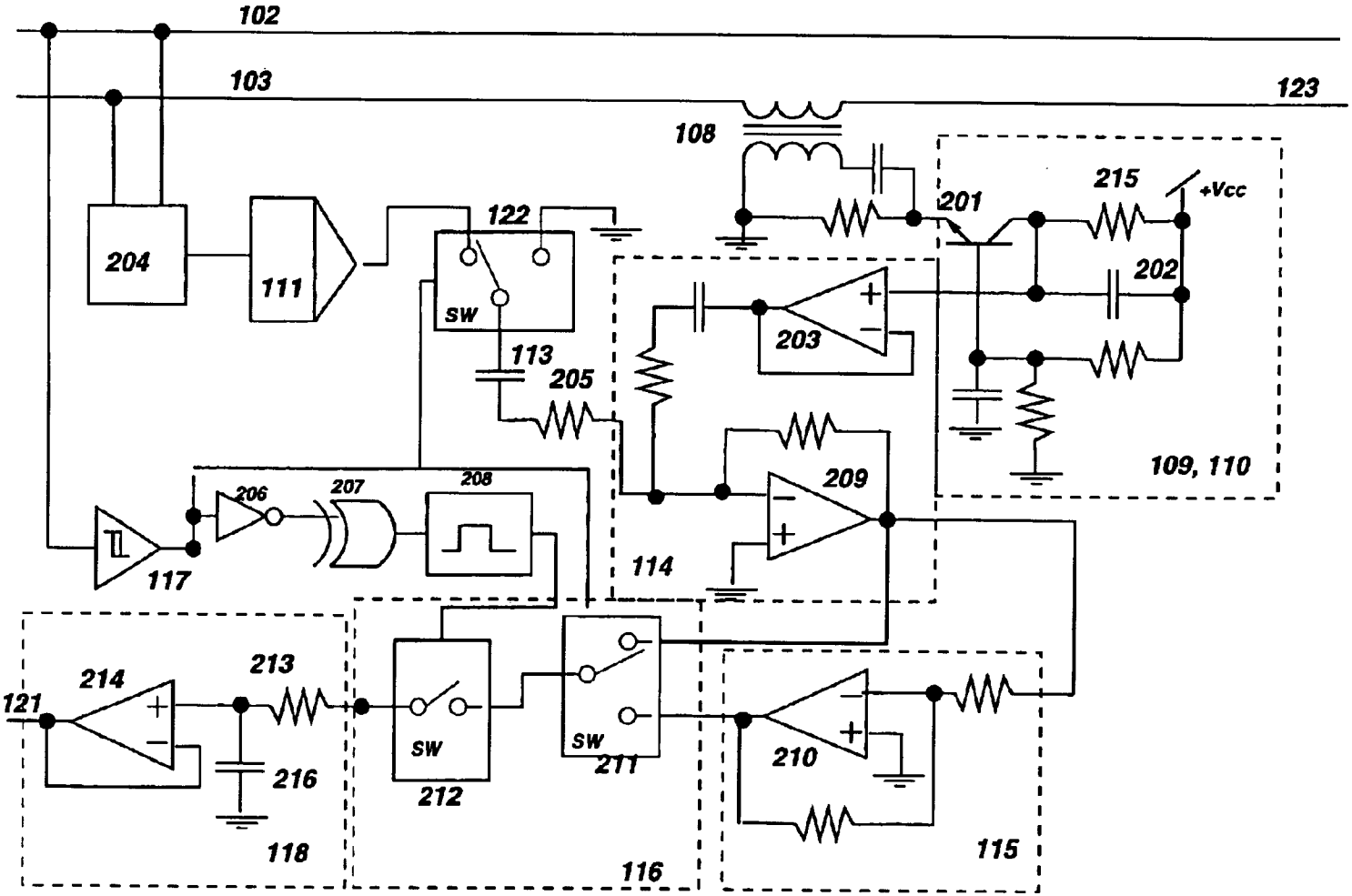
FIG. 2 shows details of an exemplary embodiment of the complete system, including DCC decoder 204, gating pulse generator 208, and switches 211 and 212.

FIG. 2 shows details of a preferred embodiment. Amplifier 109 is implemented with transistor 201 operating in the common-base arrangement. In this manner, the very short duration current spikes resulting from the fast voltage transitions on track feeders 102 and 103 are resolved in a very inexpensive manner. Such transistors commonly have bandwidths of hundreds of megahertz, with very low input impedances. A typical silicon junction transistor, such as a 2N4124, available from various manufacturers, when biased with 10 mA of collector current will exhibit an input impedance, $R_{in}$, at its emitter of less than 3 ohms. By making the secondary inductance of transformer 108, L, greater than 60 $\mu$H, the time constant formed by transformer 108 and amplifier 109 will be greater than 20 microseconds, which will allow amplifier 109 to adequately resolve the alternating current impulses at its input. Pulse filter network 110 is implemented with capacitor 202 and resistor 215. The time constant formed by resistor 215 and capacitor 202 determine the transient response time, $\tau_1$, of pulse filter network 110 and should be several times longer than the time constant formed by transformer 108 and the input impedance of amplifier 109. In this manner, current pulses will be stretched in time, decaying at a rate determined by the input time constant, $L/R_{in}$, with amplitude and overshoot substantially determined by $\tau_1$ according to well-known techniques of linear circuit analysis.

Figure 3:
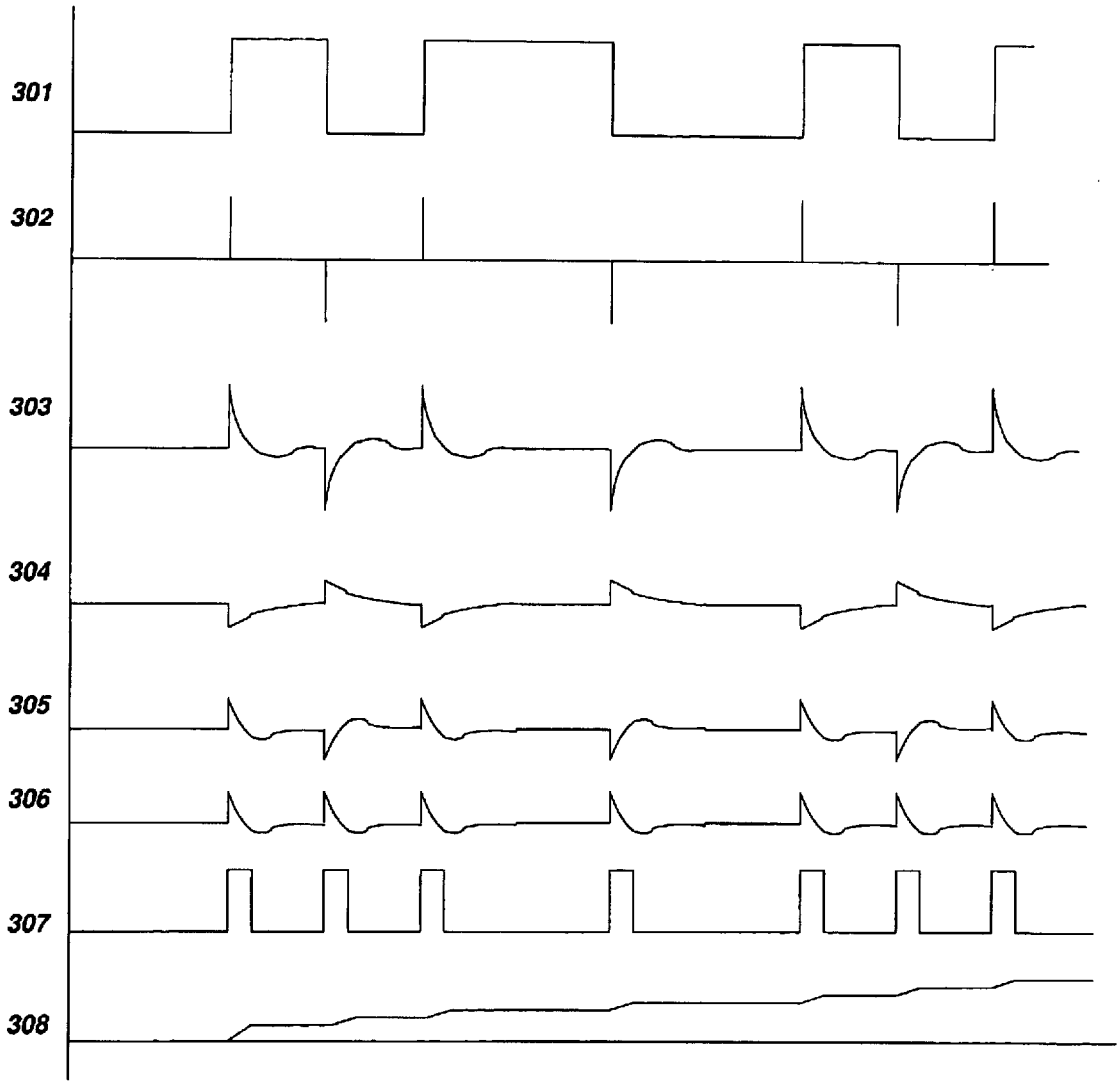
FIG. 3 shows a timing diagram for a system according to the invention, showing the various signals related to DCC track voltage represented by trace 301.

FIG. 3 shows waveforms of these signals. At 301 is shown the track voltage on feeder 103. Current pulses in the secondary winding of transformer 108 are shown at 302. 303 shows the output of pulse filter network 110, from which the two time constants are evident. The initial rise of each pulse is due to the low-pass response of pulse filter network 110 in response to the impulse-like current pulse. Due to the high-pass nature of the transformer coupling, each pulse must decay. In the typical case where $\tau_1$ is substantially greater than $L/R_1$, this decay rate is determined by the time constant $L/R_{in}$. An undershoot then occurs for each pulse, the magnitude and duration of which is largely determined by $\tau_1$ of pulse filter network 110.

In the embodiment of FIG. 2 the nulling circuit consists of DCC decoder 204, nulling DAC 111, nulling switch 122, capacitor 113, and resistor 205. The nulling operation is accomplished by the use of DCC decoder 204, which is able to produce an output according to commands received from DCC controller 101 through track feeders 102 and 103. This output is connected to nulling DAC 111, which provides suitable weighting to the alternating signals generated by nulling switch 122, such that the current injected into the summing node of operational amplifier 209 is adjustable over the desired range, while capacitor 113 and resistor 205 ensure that the current pulses decay at a pre-determined rate with each reversal of switch 122. These decaying current pulses are shown at 304 in FIG. 3. Due to the connection of switch 122, these current pulses are of the opposite polarity to those coming from pulse filter network 110.

The output of operational amplifier 209 consists of the sum of suitably integrated track current impulses, and the opposing nulling pulses. Thus, the sum, as shown at 305, is somewhat lower in amplitude and contains more undershoot than the original pulses shown at 303. Inverting amplifier 115, as implemented with operational amplifier 210, is fed, along with the un-inverted signal, to switch 211. The output of switch 211 consists of alternating samples of its two inputs, such that the orientation, or phase, of each pulse at the output of switch 211 is identical.

Due to the irregular nature of DCC signals, the durations of both positive and negative cycles can vary. Although nominally 58 microseconds for logical "one" and 100 microseconds for logical "zero", there are allowed elongated "zero" signals which can be much longer. However, since all of the time constants described for the decaying current pulses as represented at the output of switch 211 are constant, and the detector can not anticipate variations in DCC pulse widths, some means is needed to reduce the dependence of detector output on DCC data.

In order to make the detector substantially independent of these irregularities, it is necessary to form a precise "window" after each transition over which to integrate the pulse combination. In this manner, each pulse will be integrated for a constant amount of time, regardless of the duration of the DCC pulse from which it is derived. This windowing operation is accomplished with windowing switch 212.

Logic gates 206 and 207 form a transition detector, which generates a short pulse with each transition of track voltage, regardless of the polarity of that transition. At each such transition, monostable 208 generates a short windowing pulse, shown at 307. This windowing pulse is long enough to encompass the bulk of each decaying current pulse. Switch 212 then forms essentially an open circuit at its output for any time outside of this windowing pulse. However, during the windowing pulse, the output of switch 211 is passed through to low pass filter 118, consisting of resistor 213, capacitor 216, and operational amplifier 214. Were it not for the windowing operation, the output of this low-pass filter would be influenced by the duration of the DCC pulses, as longer pulses would cause an artificial decay of the voltage on capacitor 216 which would not be representative of the actual correlation process. Signal 308 of FIG. 3 shows the voltage at output 121 as a set of pulses is integrated, and held constant outside of the windows. After some amount of time, the windowed average of signal 306 is formed at signal 308, and is passed as output 121 to microcontroller 120, outfitted with suitable analog-to-digital conversion circuitry, for measurement.

It should be understood that numerous changes in details of construction and the combination and arrangement of elements and materials may be resorted to without departing from the true spirit and scope of the invention as hereinafter claimed.

What is claimed is:

1. A system for detecting occupancy of a section of track, said section including a booster serving as a source of digital command control signals, comprising:

a current transformer, placed inline between said booster and said track section;

and a correlator, connected to said current transformer;

wherein said current transformer is arranged to provide an output signal representative of the instantaneous current flowing in said track section;

and said correlator is arranged to provide an output representative of the correlation between said digital command control signals and said instantaneous current.

2. A system according to claim 1, further comprising:

a nulling circuit, arranged to provide a signal comprising pulses of adjustable amplitude, synchronous with said digital command control signals;

and a summer, connected to said current transformer and said nulling circuit, arranged to form a signal representing the difference between said output signal from said current transformer and said signal from said nulling circuit.

3. A system according to claim 2, in which said nulling circuit comprises:

a digital-to-analog converter.

4. A system according to claim 2, further comprising:

a pulse filter network.

5. A system according to claim 4, further comprising:

a microcontroller, arranged to measure the output of said correlator.

6. A system according to claim 5, wherein:

said microcontroller is arranged to make adjustments to said nulling controller.

7. A system according to claim 6, wherein:

said microcontroller is arranged to measure the voltage magnitude of said digital command control signals so as to make corrections to said output of said correlator in response to variations in said voltage magnitude.

8. A system according to claim 1 wherein:

said correlator includes a windowing switch arranged to allow operation of said correlator only during a brief interval shortly after each transition of voltage from said booster.

9. A method for detecting the occupancy of a section of track comprising the steps of:

applying digital command control signals to said track section and creating a correlation of track current resulting from voltage transitions of said digital command control signals with said digital command control signals and making a measurement of said correlation when said section of track is in an unoccupied condition;

and detecting a deviation from said measurement corresponding to occupancy of said section of track.

10. A method according to claim 9 wherein said step of measurement further includes:

adjusting a nulling controller.

11. A method according to claim 9 wherein said step of creating a correlation further includes:

performing a windowing operation which restricts the operation of said correlation to a brief interval after each of said voltage transitions.

* * * * *